US007530553B2

(12) United States Patent
Kapich

(10) Patent No.: US 7,530,553 B2
(45) Date of Patent: May 12, 2009

(54) WATER MISTING GUN

(76) Inventor: Davorin Kapich, 3111 Serrano Dr., Carlsbad, CA (US) 92009

( * ) Notice: Subject to any disclaimer, the term of this patent is extended or adjusted under 35 U.S.C. 154(b) by 537 days.

(21) Appl. No.: 11/430,807

(22) Filed: May 8, 2006

(65) Prior Publication Data

US 2006/0273194 A1 Dec. 7, 2006

Related U.S. Application Data

(60) Provisional application No. 60/680,664, filed on May 14, 2005.

(51) Int. Cl.
*B01F 3/04* (2006.01)

(52) U.S. Cl. ..... 261/28; 261/88; 261/116; 239/214.13; 239/214.17; 239/381; 169/14

(58) Field of Classification Search ..... 261/28, 261/88, 115, 116; 239/214.11, 214.13, 214.17, 239/222, 380, 381; 169/9, 14, 91
See application file for complete search history.

(56) References Cited

U.S. PATENT DOCUMENTS

| | | | | | |
|---|---|---|---|---|---|
| 2,580,384 | A * | 1/1952 | Hazen et al. | ..... | 261/24 |
| 3,090,444 | A * | 5/1963 | Bandiroli | ..... | 169/15 |
| 3,744,773 | A * | 7/1973 | Velander | ..... | 261/88 |
| 5,013,214 | A * | 5/1991 | Kapich | ..... | 415/202 |
| 5,125,797 | A * | 6/1992 | Kapich | ..... | 415/202 |
| 5,471,965 | A * | 12/1995 | Kapich | ..... | 123/565 |
| 5,904,045 | A * | 5/1999 | Kapich | ..... | 60/609 |
| 5,924,286 | A * | 7/1999 | Kapich | ..... | 60/608 |
| 5,937,833 | A * | 8/1999 | Kapich | ..... | 123/561 |
| 6,502,398 | B2 * | 1/2003 | Kapich | ..... | 60/608 |
| 2002/0095935 | A1 * | 7/2002 | Kapich | ..... | 60/599 |
| 2002/0157397 | A1 * | 10/2002 | Kapich | ..... | 60/608 |
| 2003/0037546 | A1 * | 2/2003 | Kapich | ..... | 60/608 |

* cited by examiner

*Primary Examiner*—Scott Bushey
(74) *Attorney, Agent, or Firm*—John R. Ross; John R. Ross, III

(57) ABSTRACT

A high-velocity water misting gun with a very high-speed radial inflow hydraulic turbine mounted on the same shaft with an axial flow air compressor wheel compressing air discharged at high velocities through an exhaust air nozzle. A preferred embodiment utilizes a plastic-metal hydraulic turbine wheel in which the plastic portion of the wheel other than blades is solidly anchored within a metal containing wheel. High pressure water drives the hydraulic turbine and provides water lubrication to high-speed bearings supporting a rotating shaft. The preferred embodiment utilizes hybrid bearings (part hydrodynamic, part hydrostatic) suitable for low-viscosity fluids such as water. In the preferred embodiment all of the water discharging from the hydraulic turbine wheel is channeled through a hollow shaft to a set of high-speed, shaft-mounted rotating orifices providing a fine water mist discharging into a high-velocity air flow provided by the axial-flow compressor. Thus, the entire water flow supplied to the misting gun is discharged into the high-velocity air flow discharging from an exhaust air nozzle so that no return hose is needed. Preferred embodiments utilize a manually operated ball valve to control water pressure supplied to the turbine. Increased hydraulic turbine power increases the power input into the compressor resulting roughly proportional air flow to water flow ratio.

11 Claims, 4 Drawing Sheets

WATER MISTING GUN

This application claims the benefit of Provisional Application Ser. No. 60/680,664 filed May 14, 2005. This invention relates to mist devices and in particular to mist devices for fire fighting.

BACKGROUND OF THE INVENTION

Fire fighting in close quarters buildings such as in residential homes and apartments often result in heavy water damage. The reason is that use of standard fire fighting equipment usually results in the discharge large volumes of water into the homes and apartments. These volumes are usually greatly in excess of that needed to extinguish the fire. Chemical fire extinguishers are useful for putting out small fires but are not much use against larger fires.

It is known that high pressure water mist can absorb heat at very high rates due to the large surface area of very many very small droplets. The creation of very small droplets in the range of 50 to 100 microns was found by Marioff Corporation tests to increase vaporization rates by as much as 400 times the rates of conventional sprinkler drops. However, when fighting fire in close quarters the water mist must be delivered at distances of many feet and at high rates. Also, firefighters need to be able to carry such devices up several floors and use such devices single handedly.

Fire fighting using high velocity water turbine driven fans has been in use for number of years. U.S. Pat. Nos. 5,013,214 and 5,125,797 were issued to Applicant. These fans have been utilized mostly in de-smoking operations and were sometimes equipped with liquid spray nozzles for fire fighting. Because of relatively large turbine water flow rate, spray nozzles could utilize only a small fraction of water supplied to the turbine. Thus, two large supply and drain hoses were required to carry water flows of 50 to 60 gallons per minute to and from the fire. The weight of those fans was around 40 pounds and the fire fighter also needed to carry two heavy fire hoses.

Applicant was granted on Jul. 20, 1999 a patent (U.S. Pat. No. 5,924,286) on a very high speed, high efficiency very compact radial inflow hydraulic turbine.

What is needed is a fire fighting device that can be used effectively in fighting substantial fires without producing substantial water damage.

SUMMARY OF THE INVENTION

The present invention provides a high-velocity water misting gun with a very high-speed radial inflow hydraulic turbine mounted on the same shaft with an axial flow air compressor wheel compressing air discharged at high velocities through an exhaust air nozzle. A preferred embodiment utilizes a plastic-metal hydraulic turbine wheel in which the plastic portion of the wheel other than blades is solidly anchored within a metal containing wheel. High pressure water drives the hydraulic turbine and provides water lubrication to high-speed bearings supporting a rotating shaft. The preferred embodiment utilizes hybrid bearings (part hydrodynamic, part hydrostatic) suitable for low-viscosity fluids such as water. In the preferred embodiment all of the water discharging from the hydraulic turbine wheel is channeled through a hollow shaft to a set of high-speed, shaft-mounted rotating orifices providing a fine water mist discharging into a high-velocity air flow provided by the axial-flow compressor. Thus, the entire water flow supplied to the misting gun is discharged into the high-velocity air flow discharging from an exhaust air nozzle so that no return hose is needed. Preferred embodiments utilize a manually operated ball valve to control water pressure supplied to the turbine. Increased hydraulic turbine power increases the power input into the compressor resulting roughly proportional air flow to water flow ratio.

DETAILED DESCRIPTION OF THE PREFERRED EMBODIMENTS

First Preferred Embodiment

A first preferred embodiment can be described by reference to FIGS. 1-5.

Water Turbine Driven Air Compressor

Figure 1:
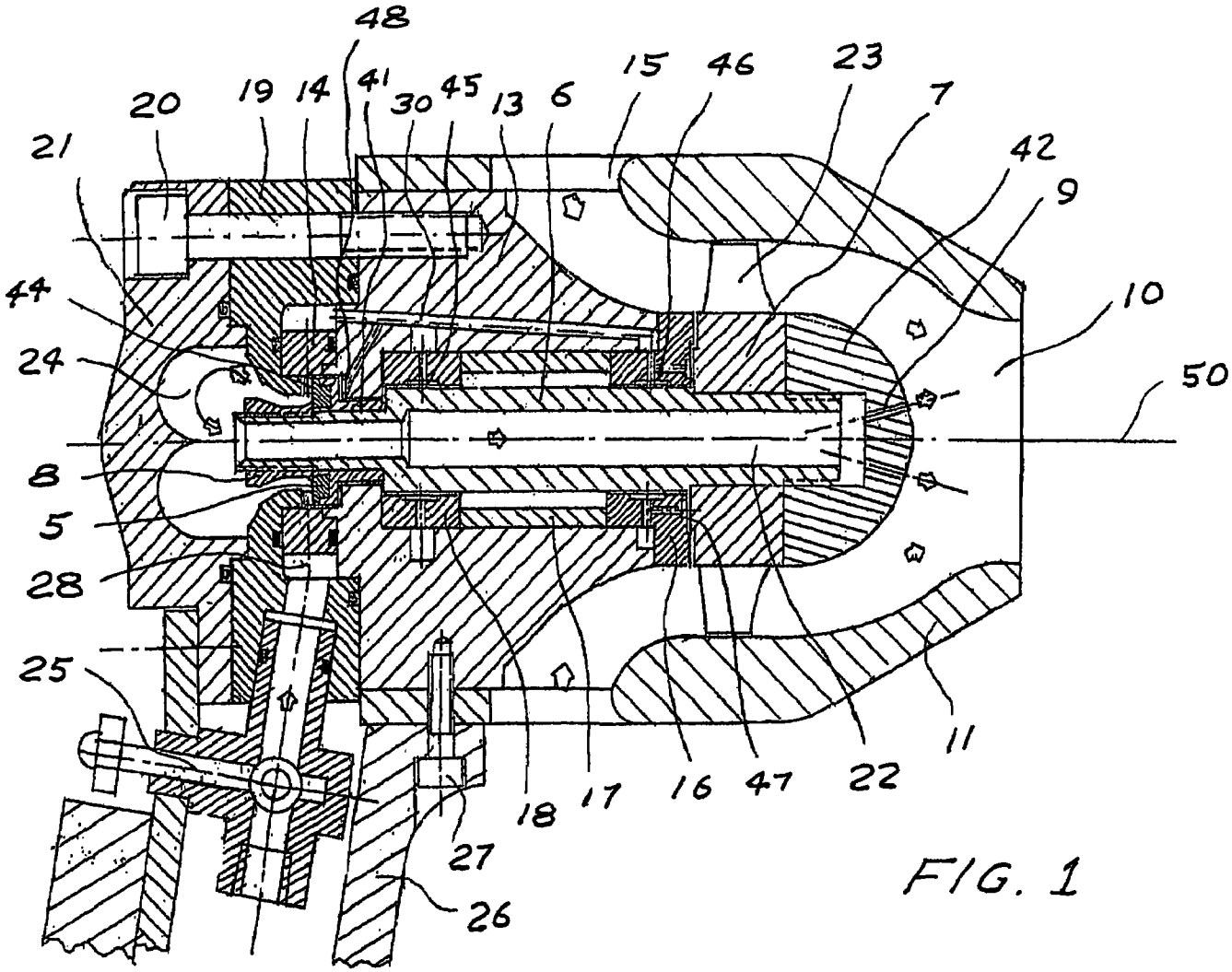
FIG. 1 is a drawing of a preferred embodiment of the present invention.
Figure 2:
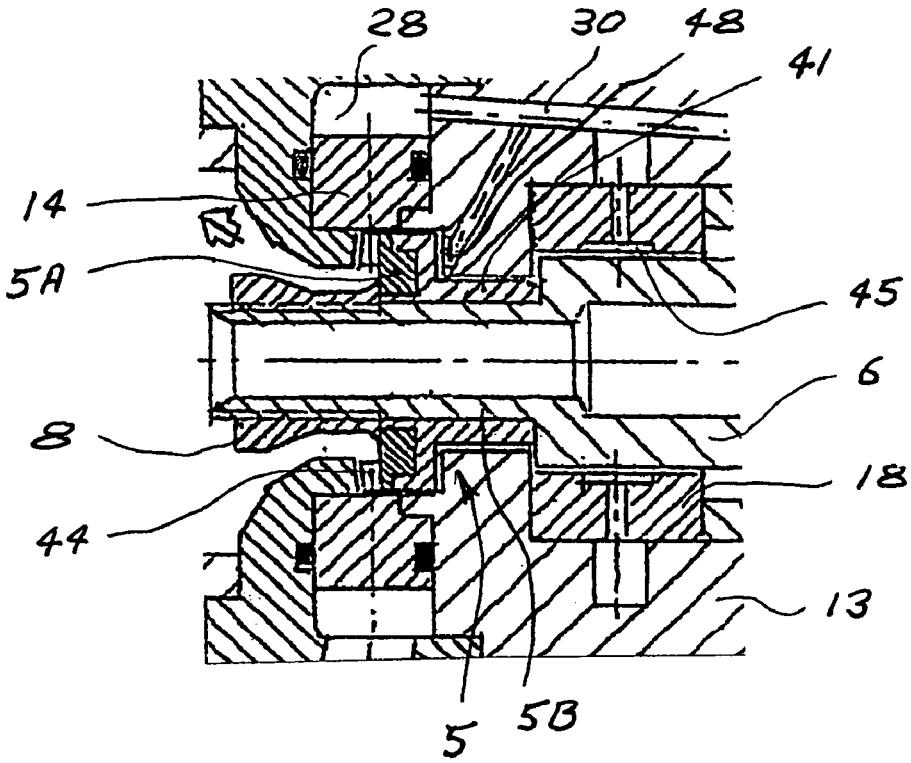
FIGS. 2 and 3 show some important features of the preferred embodiment.
Figure 3:
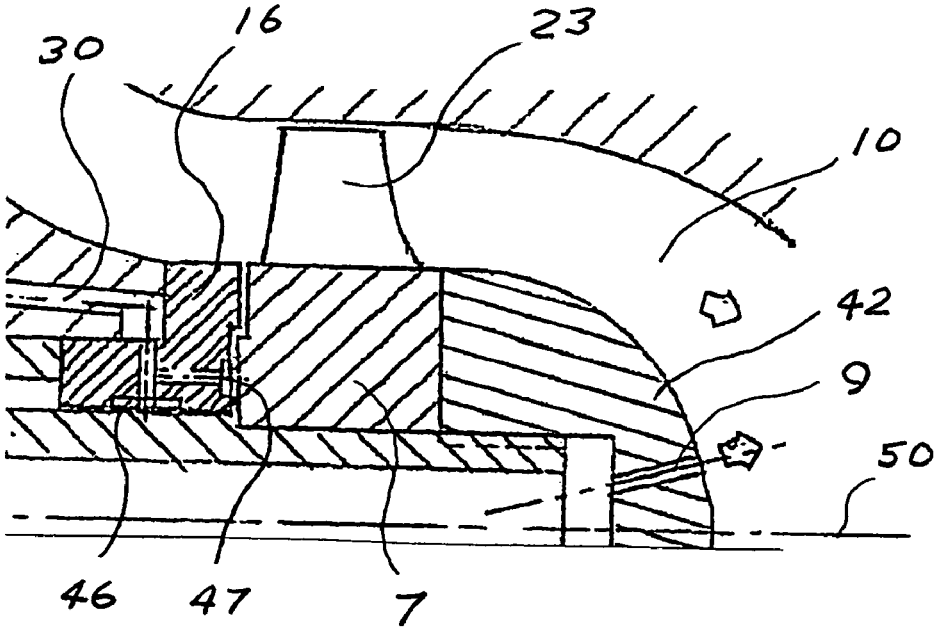

As shown in FIGS. 1 and 2, turbine wheel 5 is comprised of plastic and metal. The plastic portion 5A is solidly anchored within metal containing wheel 5B and solidly pressed onto hollow shaft 6 via wheel nut 8. Compressor wheel 7 as shown in FIG. 3 is solidly attached to hollow shaft 6 by hub nut 42 which incorporates multiple water misting nozzles 9. In order to maintain shaft dynamic balance, water misting nozzles 9 are positioned on opposite sides of each other across rotor centerline 50 and under slight angle which in conjunction with high speed rotation of water misting nozzles 9 attached to hollow shaft 6 facilitate improved mixing of water droplets with high velocity air flow produced by compressor blades 23. Compressor blades 23 are aerodynamically designed and this design has been checked in two-dimensional cascade tests of NACA 65 Series compressor blades as reported in NACA Report No. 1368. Optimized compressor design using such NACA 65 Series blades data has produced aerodynamic efficiencies in excess of 80 percent in subsonic compressors that have been designed and built by Applicant.

Water Bearings

Bearing housing 13 shown in FIG. 2 contains radial bearing 18 and radial/axial bearing 16. Bearings spacer 17 shown in FIG. 1 fixes the position of radial bearing 18 relative to radial/axial bearing 16. Radial bearing 18 incorporates orifice compensated bearing pockets 45 as shown in FIG. 2. The function of orifice compensated bearing pockets 45 is explained below. Radial/axial bearing 16 incorporates orifice compensated radial bearing pockets 46 and axial bearing pockets 47. Thrust force produced by pressure differential across compressor blades 23 produces axial force acting on axial bearing pockets 47. The back side of metal containing wheel 41 serves as reverse thrust bearing collar in conjunction with reverse thrust bearing pockets 48. Reverse thrust load occurrence is unlikely although it is possible during aerodynamically unstable flow across compressor blades 23. Small amounts of bearing water, less than 0.5 gallon per minute leaks radially outward through small axial gap, less than 0.003 inch wide between radial/axial bearing 16 and compressor wheel 7 and into air flow entering compressor blades 23 where it mixes further downstream with water mist in the air nozzle 10.

Orifice compensated bearings are needed to produce hydrostatic load carrying capability of radial and thrust bearings when lubricated with water. Water at such bearing velocities and clearances produces turbulent lubricating films as compared to engine oil (with much higher viscosity) that produces laminar oil films. Turbulent films alone without hydrostatically orifice compensated pockets are not capable of carrying bearing loads. Applicant has extensive experience in designing, manufacturing and testing of such turbulent film water lubricated bearings in sizes from 0.20 to 9.00 inch in diameter.

Water passage 30 provides high pressure water lubrication to journal bearing 18, radial/axial bearing 16 and reverse thrust bearing pockets 48. Turbine inlet cavity 28 provides water flow to water passage 30. Turbine inlet cavity 28 is supplied with high pressure water via ball valve 25 shown in FIG. 1, and high pressure water hose (not shown) but connected to gun handle 26. Turbine housing 19 contains turbine nozzle ring 14 and provides close axial clearance to turbine blades 44 which are part of turbine wheel 5. Turbine rear cover 21 encloses turbine discharge cavity 24. A series of bolts 20 keeps turbine cover 21 and turbine housing 19 pressed closely together against bearing housing 13.

Compressor

Compressor blades 23 are solidly attached to compressor wheel 7. Air discharge nozzle body 11 shown in FIG. 1 is attached to bearing housing 13 by close fit and series of bolts 27. Air discharge nozzle body 11 incorporates air inlet slots 15 allowing for ambient air to enter into compressor blades 23 where the air is compressed and then expanded and discharged through the air nozzle 10. Air discharge nozzle body 11 is designed to contain the compressor blades 23 and fragments in case of compressor blades 23 failure. Gun handle 26 (shown only partially) is solidly attached to bearing housing 13 by series of bolts 27 and other bolts not shown.

Water Turbine

Figure 4:
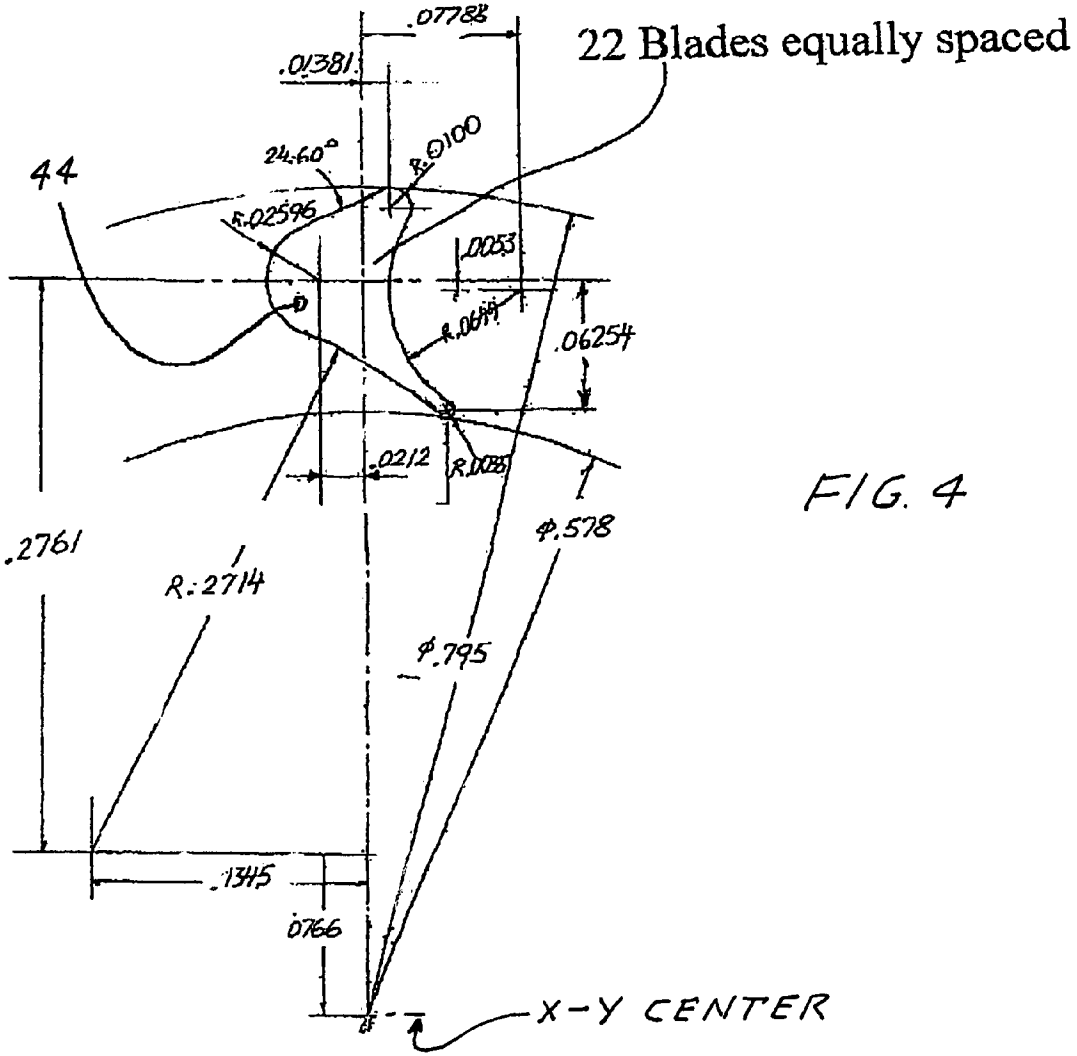
FIG. 4 shows a turbine blade design.
Figure 5:
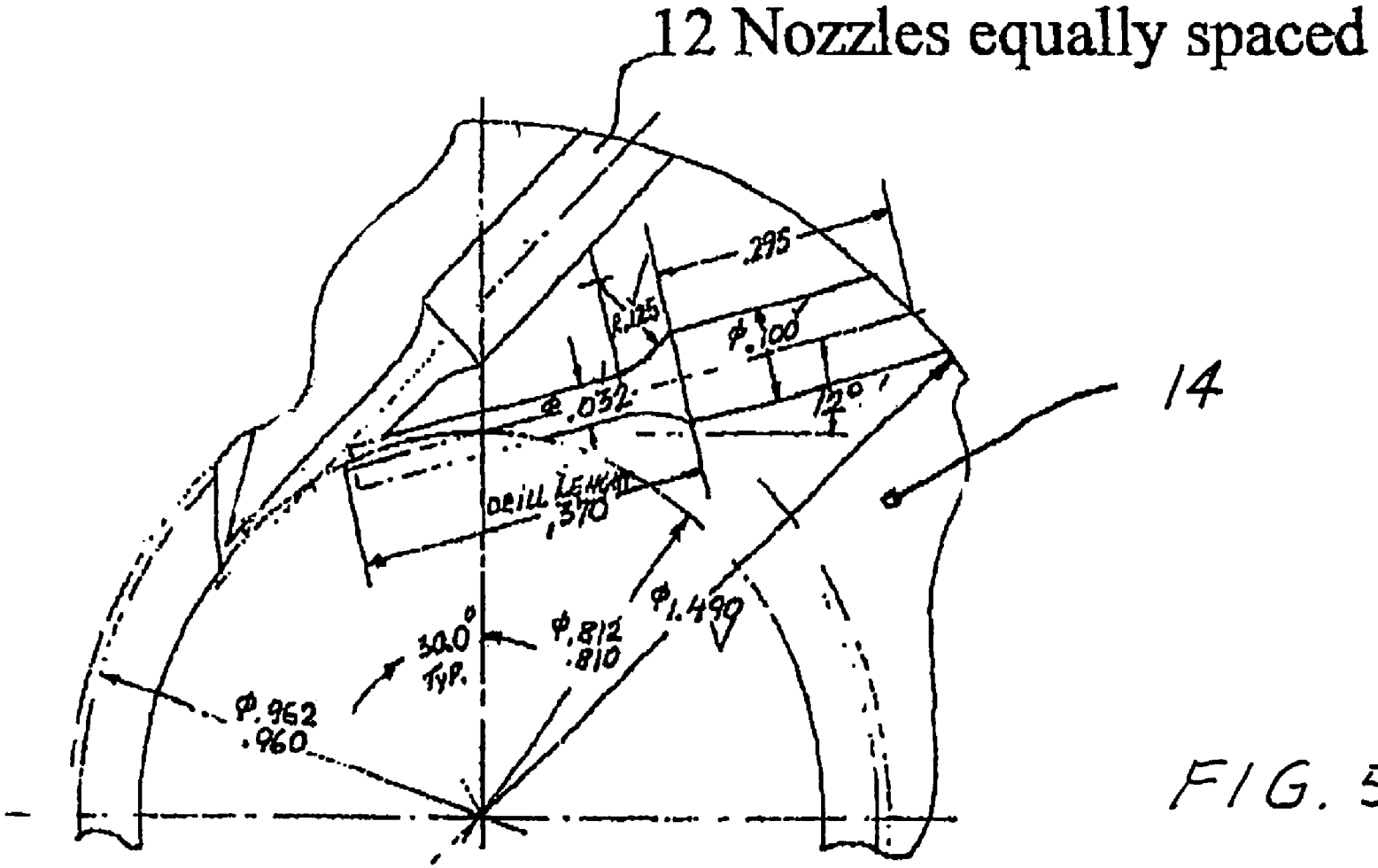
FIG. 5 shows a turbine nozzle design.

High pressure water is supplied preferably at pressures of 1500 to 1800 pounds per square inch and at a rate of up to 10 gallons per minute into turbine inlet cavity 28 via ball valve 25. High pressure water flows through a series of nozzle holes optimally positioned in the turbine nozzle ring 14 driving turbine wheel 5 as shown in FIG. 2. Water discharging from turbine wheel 5 flows into turbine discharge cavity 24 where it makes 180 degree turn (as shown by two arrows at 24) and flows into the hollow channel 22 of hollow shaft 6 and to water misting nozzles 9 in hub nut 42. Water misting nozzles 9 are sized to produce water pressure up to 400 psi through water misting nozzles 9 and up to 1300 psi through the turbine nozzles 14 and turbine wheel 5. The diameter of water misting nozzles 9 can vary from 0.5 mm to 1.2 mm and number of water misting nozzles 9 can vary from 4 to 36. Turbine blades are shown in FIG. 4 and turbine nozzles are shown in FIG. 5.

The high-speed hydraulic turbine shown as turbine nozzles 14 and turbine wheel 5, produce about 3.3 HP @ 60,000 rpm with 1300 psi supply pressure and 8 gallons per minute water flow. This is sufficient to drive axial flow compressor producing about 265 cfm air flow and 480 ft/sec air velocity and a water mist of up to 10 gallons per minute. The hydraulic turbine maximum capability has been tested by Applicant on other application at 2500 psi supply pressure producing ~20 HP @ 85,000 rpm.

The hydraulic turbine utilizes the special geometry of turbine nozzles arrangement shown in FIG. 16-19 in U.S. Pat. No. 5,924,286, issued to the Applicant on Jul. 20, 1999, with the exception that the turbine shown in FIG. 1 is scaled down in diameter from 0.979 inch to 0.805 inch.

Heat Absorbing Mist

Water and air mist flow containing 10 gallons per minute of water is capable of absorbing approximately 100,000 btu per minute of fire generated heat. If desired, capacity can be increased or decreased with the preferred embodiment by increasing or decreasing hydraulic turbine pressure in the range from about 1000 psi to about 2500 psi with resultant increase or decrease in flow capacities of water turbine wheel 5 and compressor blades 23.

High Pressure Water Supply Unit

A high pressure water supply unit is needed to deliver water to the high velocity water misting gun. A wide choice of high pressure water supply pumps is available to supply the high pressure water needed to drive the above preferred embodiment. These pumps are currently typically used as high-pressure washers. Engine driven and electric motor driven mobile units are available in power range up to 25 horsepower, pressures up to 5000 psi and flows up to 8 gallons per minute. Northern Tool & Equipment Co., P.O. Box 1499, Burnsville, Minn. 55337-0499 has a large choice of such pump units for sale. Single or multiple pump units can be utilized to supply required high pressure water to power the misting gun. Pressure water hoses in lengths up to 100 ft, rated at 4000 psi are available from Northern Tool Co. The 100 ft long hose weighs only 31 pounds and has ⅜ inch swivel connections allowing for longer hose extension. This allows fire fighters to quickly reach upper floors of multiple story dwellings.

Advantages of the Present Invention

The present invention provides a very compact hand held, water turbine driven very high speed axial flow compressor producing air jet with 400 to 600 ft/sec velocity capable of carrying up to 10 gallons per minute water in fine mist form to estimated distance of 20 to 30 feet. The gun uses only one light weight hose supplying high pressure water to drive a water turbine and uses the entire turbine water flow to generate fine mist for fire fighting. The gun provides water mist with extremely small water droplets by ejecting water through a set of hydraulic turbine driven water nozzles rotating at speeds from 60,000 to 100,000 RPM and mixing them with 400 to 600 ft/sec air flow generated by the hydraulic turbine driven axial flow compressor. The gun is hand held. The turbine discharge water flow is reversed through a hollow rotating shaft and discharges through a set of rotating nozzles in the same general direction as high velocity air flow produced by the axial flow compressor.

Although the present invention has been described above in terms of a preferred embodiment, persons skilled in this art will recognize that many changes and additions could be made without departing from the spirit of the invention. For example, flow rates and pressures could be varied substantially. What is important is that all of the water driving the turbine to provide the air flow to carry the mist to the fire be turned into mist to be carried to the fire. Some modifications to the turbine design are possible; however, high speed turbines, similar to the one described, are greatly preferred. Therefore, the scope of the invention should be determined by the appended claims.

I claim:

1. A high-velocity water misting gun system comprising:

A) a main shaft,

B) at least two high-speed water bearings supporting said main shaft,

C) a very high-speed hydraulic turbine mounted on said main shaft,

D) an exhaust air nozzle,

E) an air compressor wheel mounted on said main shaft for compressing air to be discharged through said exhaust air nozzle, and F) a high pressure water supply for supplying water to drive the hydraulic turbine and provide lubrication to high-speed bearings supporting a rotating shaft and to be turned into mist and mixed with the compressed air discharged from said exhaust air nozzle.

2. The misting gun system as in claim 1 wherein all or substantially all of the water supplied by said water supply is turned into mist and mixed with the compressed air.

3. The misting gun system as in claim 1 wherein said hydraulic turbine is a radial inflow hydraulic turbine.

4. The misting gun system as in claim 1 wherein said hydraulic turbine comprised a plastic-metal hydraulic turbine wheel in which the plastic portion of the wheel other than blades is solidly anchored within a metal containing wheel.

5. The misting gun system as in claim 1 wherein said air compressor wheel is an axial flow compressor wheel.

6. The misting gun system as in claim 1 wherein said water bearings are hybrid water bearings, part hydrodynamic and part hydrostatic.

7. The misting gun system as in claim 1 wherein said main shaft is hollow with discharge orifices.

8. The misting gun system as in claim 7 wherein all of the water discharging from the hydraulic turbine is channeled through said hollow shaft and said orifices to provide, with the shaft rotating, a fine water mist discharging into high-velocity air flow provided by the air compressor.

9. The misting gun system as in claim 1 wherein said high pressure water supply comprises a gasoline pump.

10. The misting gun system as in claim 1 wherein said high pressure water supply comprises an electric pump.

11. The misting gun as in claim 1 and further comprising a manually operated ball valve to control water pressure supplied to the turbine.

* * * * *